US006484877B1

(12) United States Patent
Murakami et al.

(10) Patent No.: US 6,484,877 B1
(45) Date of Patent: Nov. 26, 2002

(54) PACKAGING ELEMENT OF TIRE WHEEL

(75) Inventors: Yoshiharu Murakami, Osaka; Akira Kurebayashi, Toyokawa; Shigeki Urai, Nagoya; So Kawamura, Kasugai; Kunihiko Iwahara, Gifu, all of (JP)

(73) Assignee: NGK Insulators, LTD, Nagoya (JP)

( * ) Notice: Subject to any disclaimer, the term of this patent is extended or adjusted under 35 U.S.C. 154(b) by 0 days.

(21) Appl. No.: 09/705,934

(22) Filed: Nov. 6, 2000

(30) Foreign Application Priority Data

Nov. 5, 1999 (JP) ..... 11-314697

(51) Int. Cl.[7] ..... B65D 85/02

(52) U.S. Cl. ..... 206/303; 108/55.3; 206/335; 206/821

(58) Field of Search ..... 108/53.1, 53.5, 108/55.1, 55.3; 206/303, 304, 304.1, 304.2, 327, 419, 422, 499, 597, 821, 335; 211/23, 24, 49.1

(56) References Cited

U.S. PATENT DOCUMENTS 977,935 A * 12/1910 Cooper ..... 206/422
1,523,510 A * 1/1925 Bray ..... 211/23
3,012,663 A * 12/1961 Thorne ..... 206/304
3,771,646 A * 11/1973 Masceti, Jr. ..... 206/327
3,850,295 A * 11/1974 Black ..... 206/304
3,961,707 A * 6/1976 Lehr et al. ..... 206/419
4,998,619 A * 3/1991 Sowa et al. ..... 206/597
5,531,327 A * 7/1996 Darby ..... 206/597
5,647,284 A * 7/1997 Frysinger et al. ..... 108/53.1
5,826,716 A * 10/1998 Wilson ..... 206/304

* cited by examiner

*Primary Examiner*—Jim Foster
(74) *Attorney, Agent, or Firm*—Armstrong, Westerman & Hattori, LLP

(57) ABSTRACT

A packaging assembly for efficiently packaging wheels includes multiple sheets of supporting and fixing members. A first set of wheels, each wheel having a and engaging a hub hole of one of the sheets, is located between two of the sheets. A first sheet supports a first set of wheels, and a second sheet is supported by the first set of wheels. A second set of wheels is located between the second sheet and a third sheet, each wheel of the second set including a hub engaged with a hub hole of the third sheet or of one of the first two sheets. The hub engagement of each wheel is laterally offset from the perimeter of all of the wheels of adjacent sets of wheels. The packaging includes means for preventing lateral movement of the wheels in each set.

7 Claims, 10 Drawing Sheets

PACKAGING ELEMENT OF TIRE WHEEL

BACKGROUND OF THE INVENTION

1. Field of the Invention

The present invention relates to a packaging element of a tire wheel a hub of which is projected from a rim side face, mainly to a packaging element of a tire wheel for a motorcycle.

2. Prior Art

In recent times, a request for effective utilization of limited resources is intensive and it has been recommended the research and development of products keeping in mind reuse or renewal of materials in various fields.

Particularly, in exports such as automobiles or precision machines and in situations instead of exporting a finished product, an assembly plant is installed at overseas sites and parts are exported to and assembled at that site, there is extremely high need for a packaging element of parts in order to ensure its safety and economic performance of transportation, storage, as well as effective utilization of the packaging component in view of resources.

In packaging and transporting tire wheels (hereinafter, referred to as wheels) for automobiles, particularly for motorcycles having a hub projected from a rim side face, according to packaging means in which wheels of a single vehicle or several vehicles are put into a cardboard case, although the wheel diameter stays the same, the width and a projected dimension of the hub portion differ. Therefore, in piled-up packaging where the hubs of the wheels are vertical, not only the loading state is unstable but also damage, deformation or the like of the rims or the hubs are induced since the parts are brought into contact with each other and adversely affecting the quality. Therefore, the piled-up packaging is difficult to adopt so, in the present circumstances, individual wheels are still put into cardboard cartons, the cartons are piled up on a pallet and bound by bands and transported.

However, according to the above-described conventional individual packaging means of tire wheels, when individual tire wheels are put into cardboard cases, in packaging operation and opening operation thereof, in view of labor and in view of time, time and labor are required more than necessary and the loading efficiency of a container is deteriorated since a volume of each box is increased.

Further, for tire wheels having different widths and projected dimensions of hubs, it is necessary to fabricate and prepare many kinds of cardboard boxes. In addition thereto, it is particularly problematic that it is uneconomical, in view of a storage environment (piled-up in the outside) and a loading space for returning the packaging elements for cardboard boxes or wood boxes, as packaging elements once used. Particularly, durability cannot be ensured in cardboard boxes as packaging elements and therefore, opened fiberboard boxes are scrapped without being reused as packaging elements.

In the meantime, when packaging means are excellent in durability such as a delivery container made of synthetic resin is adopted instead of cardboard packaging there are inconveniences. Although an economic effect in view of resources is achieved by repeated use thereof, economic burden for recycle such as its bulkiness, inconvenience in handling or the like becomes more than an uneconomic effect of scrapping fiberboard boxes. Further, the container is bulkier than the fiberboard package, the loading efficiency of the container is deteriorated and therefore, those means are difficult to adopt.

It is purpose of the present invention to provide a packaging element of a tire wheel which is excellent in returnability achieving rationalization of physical distribution expense such as effective utilization of resources and reduction in packaging waste by repeated use, ensuring of safety of parts, efficiency of transportation and loading, promotion of economic performance of transportation for storage and reuse of packaging elements and the like.

SUMMARY OF THE INVENTION

According to an aspect of the present invention, there is provided a packaging element of a tire wheel, wherein there are used, as one set, three sheets or more of supporting and fixing members (1) constituting a packaging object by a tire wheel (H) having a hub projected from one side face or two side faces of a rim. The fixing member (1) provides hub holes (11) having a number twice or more as much as a number of the tire wheels supported by each of supporting base plates (10) at the supporting base plates (10) constituted substantially by a rectangular contour having a size equal to or smaller than a contour size of a pallet (P) to piled up while being shifted at the respectives of the supporting base plates (10) to thereby arrange the hub holes (11) to dispose at a loading space without interfereing with each hubs of the tire wheels (H) at one or both of upper and lower sides thereof. The base plates (10) having movement hampering means for preventing movement of the tire wheels (H) at surroundings of the hub holes (11) in correspondence with the number of the tire wheels to be supported at a surface of the supporting base plate (10) and at respectives of surroundings of others of the hub holes (11) at a rear face of the supporting base plate (10).

According to the packaging element (which is the supporting and fixing member (1)) of a tire wheel of the invention constituted as described above, firstly, one sheet of the supporting and fixing members (1) is placed on a pallet (P) with a face thereof having the movement hampering means on the surface side at surroundings of the hub holes (11) of a central portion and on sides of four corners, directed upwardly. The hub portions constituting projected portions of the tire wheels (H) are fitted to respectives of the hub holes (11) of the central portion and on the sides of the four corners and at the same time, the rims are fitted to the movement hampering means on the surface side. For example, in the case of nine hub holes (11) of the supporting base plate (10) in three rows in longitudinal and transverse directions, five tire wheels (H) are supported. Thereafter, the face having the movement hampering means on the surface side directed downwardly, a second one of the supporting and fixing member (1) is piled up without discrepancy between the upper side and the lower side and five tire wheels (H) are sandwiched such that the face having the movement hampering means on the rear face side constitute the upper face.

Further, by such a procedure, for example, by using six sheets of the supporting and fixing members (1), the tire wheels (H) are loaded in five stages alternately in five pieces, four pieces, five pieces, four pieces. Or respective four tire wheels (H) are loaded while being shifted in the up and down direction by using six sheets of the supporting and fixing members (1) each having eight hub holes (11) along sides of a rectangle in which the hub hole (11) is not present at the central portion, described selectively in Claim 2. Thereafter, the total is bound and packaged by wrapping bands (V) in longitudinal and transverse directions and the total is loaded to a container by using a material handling vehicle such as a fork lift and then transported.

Further, in collecting the used packages, by a procedure reverse to the above-described, the package is opened, the tire wheels (H) are taken out, thereafter, the respective supporting and fixing members (1) are piled up, bound by the bands (V) and recovered.

According to the packaging element of the tire wheel (H) of the invention, the hub of the tire wheel (H) is projected from the opened hub hole (11) at a second one of the supporting and fixing member (1), however, the hub hole (11) contiguous to the hub hole (11) is not closed and is brought into an opened state.

Therefore, the respective hubs of the piled-up tire wheels (H) on the upper side and the lower side do not interfere with each other. The same goes with the case in which the tire wheel (H) are loaded in several stages alternately by five pieces, four pieces, five pieces, four pieces . . . or in four pieces by using a plurality of the supporting and fixing members (1).

Further, the tire wheels (H) at the respective stages do not move horizontally owing to the movement hampering means respectively on the surface side and the rear face side.

Further, in recovering the above-described packaging elements, in piling up the supporting and fixing members (1), the supporting and fixing members (1) are piled up with low bulk in a stable state in which the respective movement hampering means on the surface side and rear face side are brought,in mesh with each other and are not shifted horizontally and are enabled to be bound by the bands (V).

Further, even in the case in which the diameter of the tire wheel (H) is the same and the rim width is different, a difference of the rim's width is about 1 thorough 3 cm and therefore, when the supporting and fixing member (1) is fabricated with the tire wheel (H) having a wide width as referenced, in piling up the tire wheels (H) having a narrow rim width, when one sheet or several sheets of extra ones of the supporting and fixing members (1) are used as spacers, there is no hazard in adjusting the loading height of the container.

DETAILED DESCRIPTION OF THE INVENTION (Embodiment 1)

According to Embodiment 1 of the invention, a packaging object is constituted by a tire wheel (H) for a motorcycle which is a tire wheel (H) having a hub projected from both side faces of a rim. An explanation will be given of a packaging element (which is supporting and fixing member (1)) integrally molded by using a hard synthetic resin material having thermoplasticity in reference to the drawings. Incidentally, according to "supporting base plate (10)" described in Embodiment 2 and Embodiment 4, there is included a constitution formed with perforated windows for saving material, reducing weight and molding, further, with regard to ribs provided with a purpose of reinforcement, an explanation will not be particularly given thereof and the ribs are only illustrated.

Figure 1:
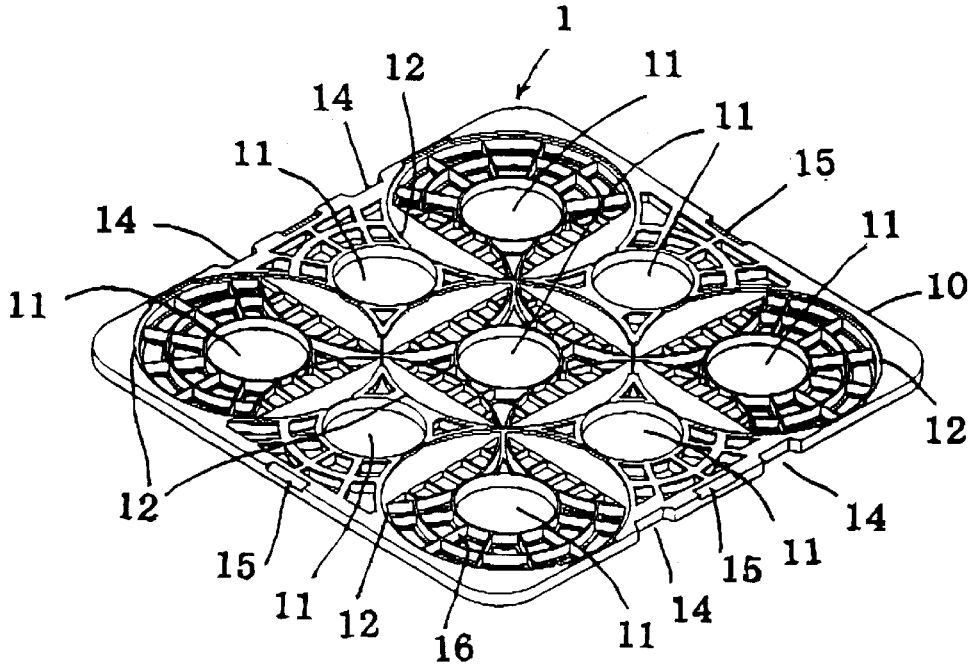
FIG. 1 is a perspective view of a surface of a supporting and fixing member constituting a packaging element according to Embodiment 1.
Figure 2:
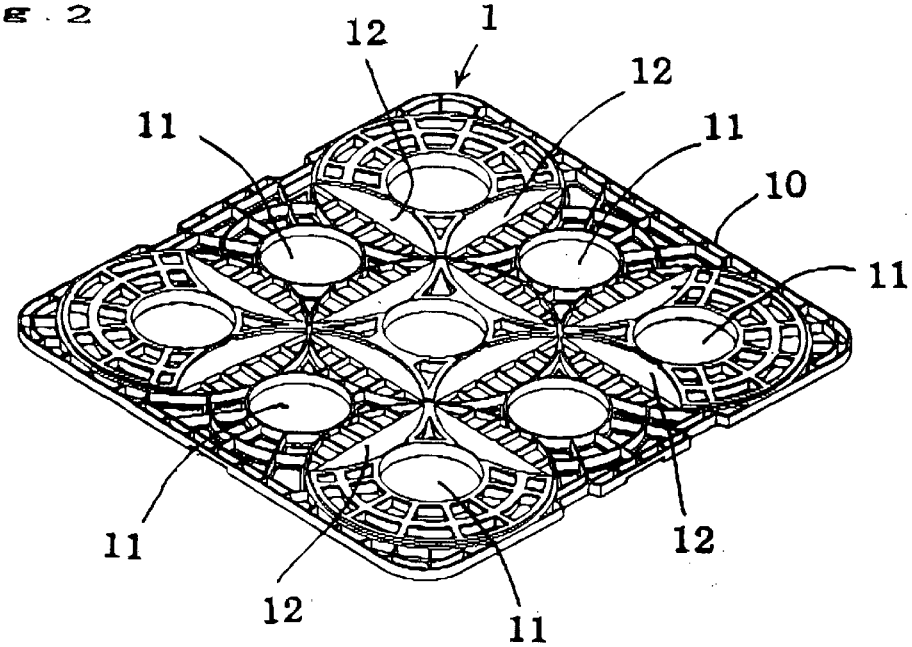
FIG. 2 is a perspective view of a rear face of the supporting and fixing member.
Figure 3:
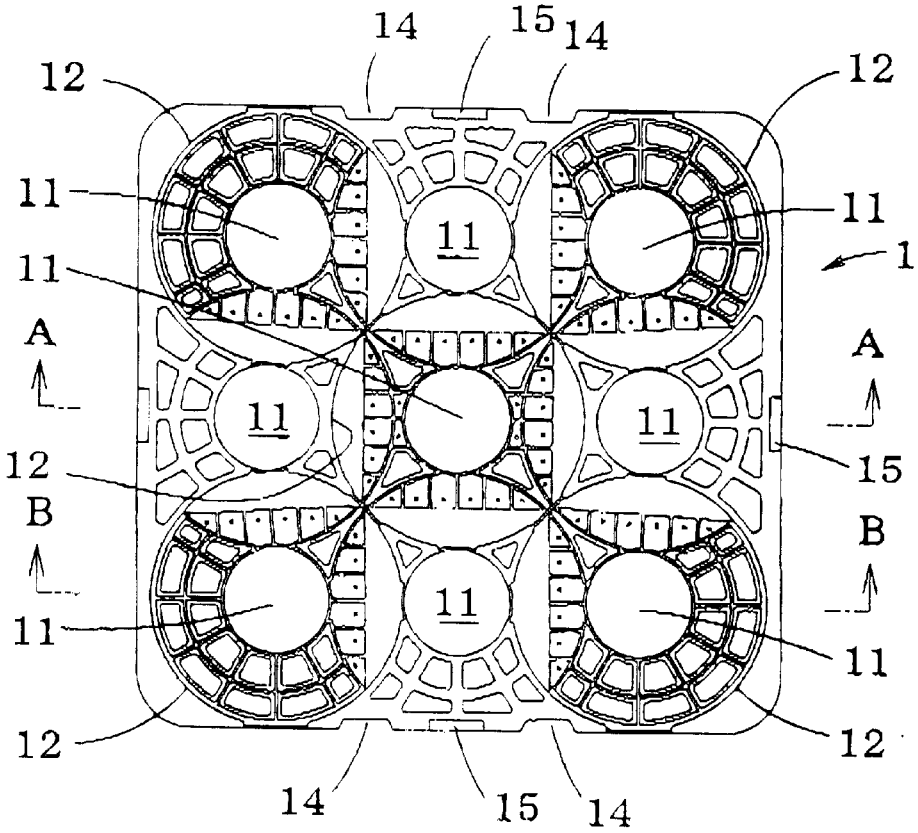
FIG. 3 is a top view of the supporting and fixing member.
Figure 4:
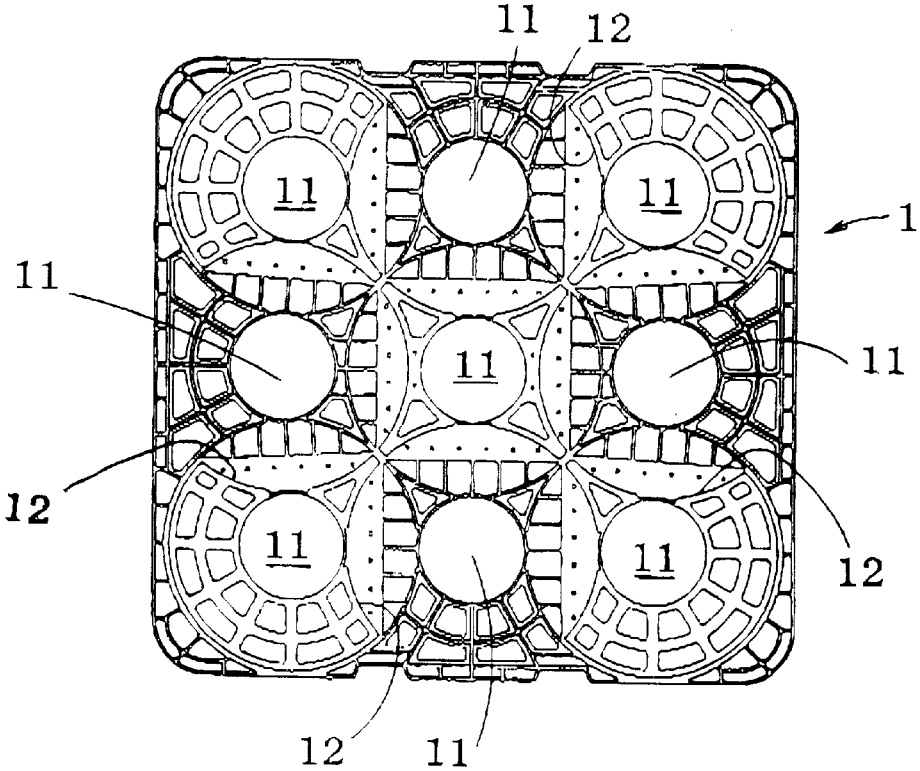
FIG. 4 is a rear view of the supporting and fixing member.
Figure 5:
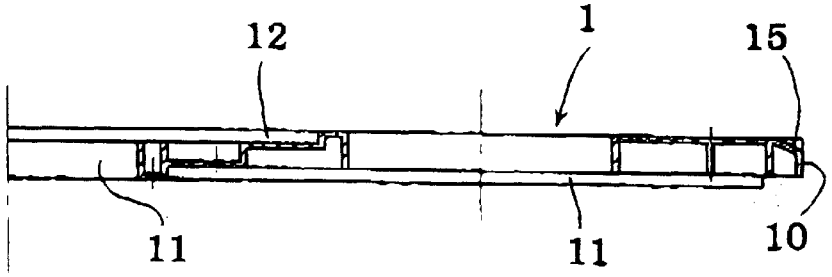
FIG. 5 is an enlarged sectional view taken along a line A—A in FIG. 3.
Figure 6:
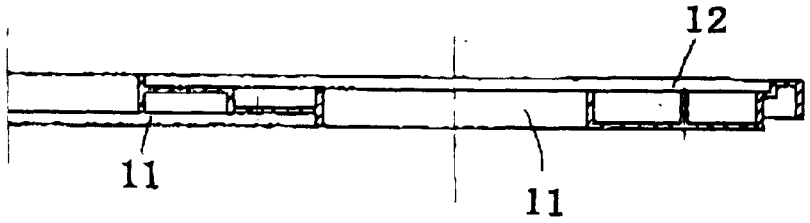
FIG. 6 is an enlarged sectional view taken along a line B—B of FIG. 3.
Figure 7:
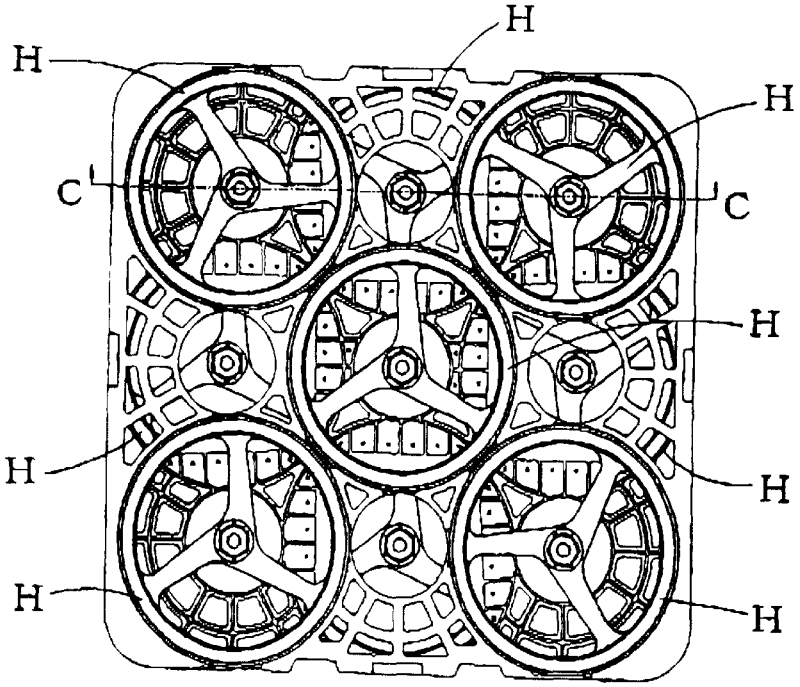
FIG. 7 is a plane view showing a state of piling up tire wheels.
Figure 8:
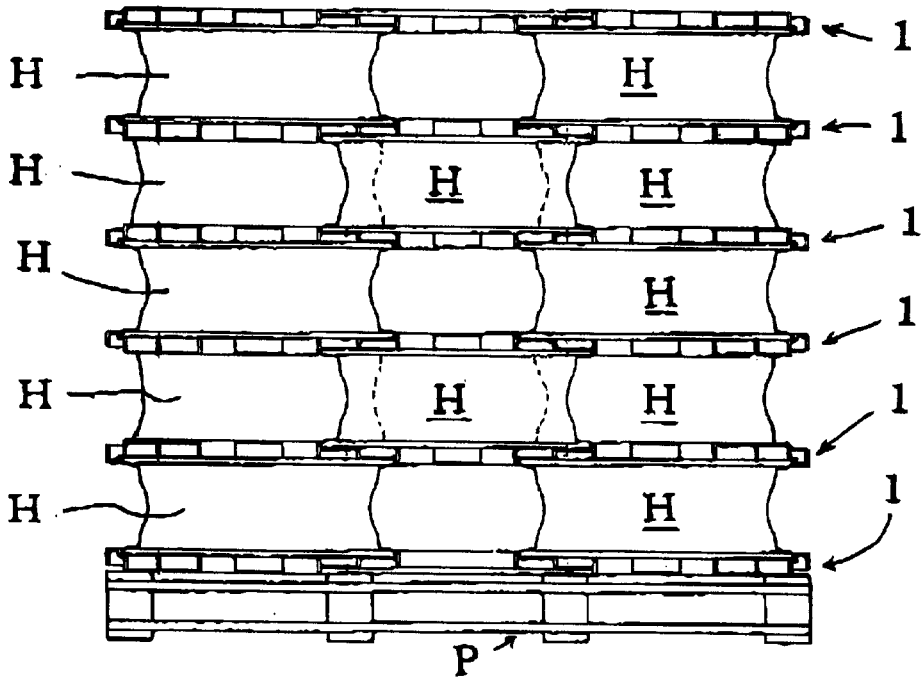
FIG. 8 is a front view showing a state of piling up tire wheels.
Figure 9:
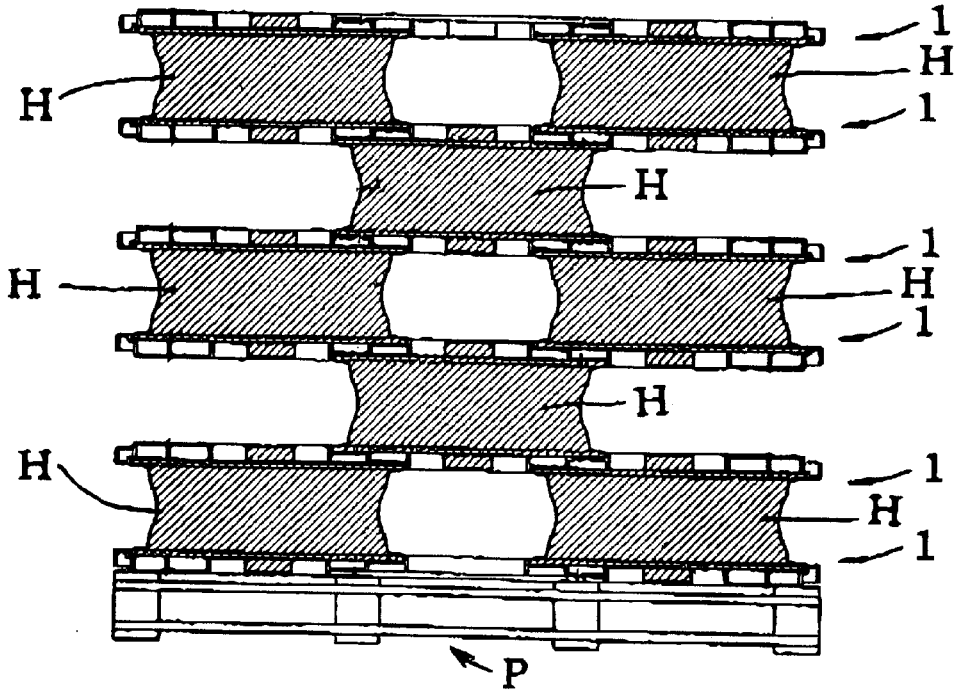
FIG. 9 is an outline sectional view taken along a line C—C of FIG. 7.
Figure 10:
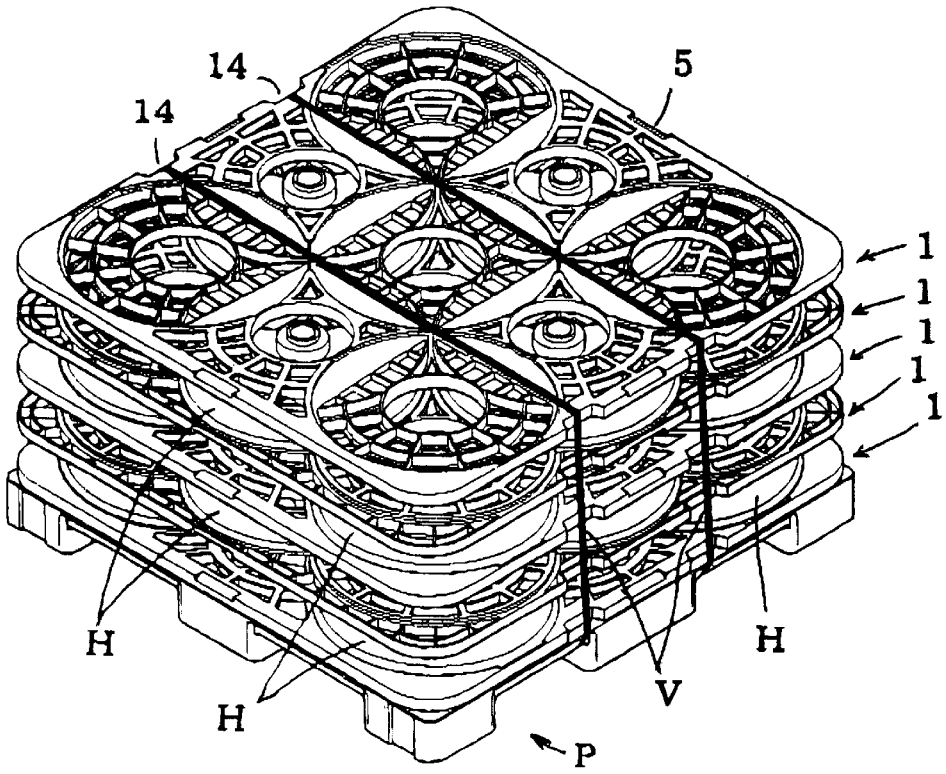
FIG. 10 is a perspective view of a packaged state.
Figure 11:
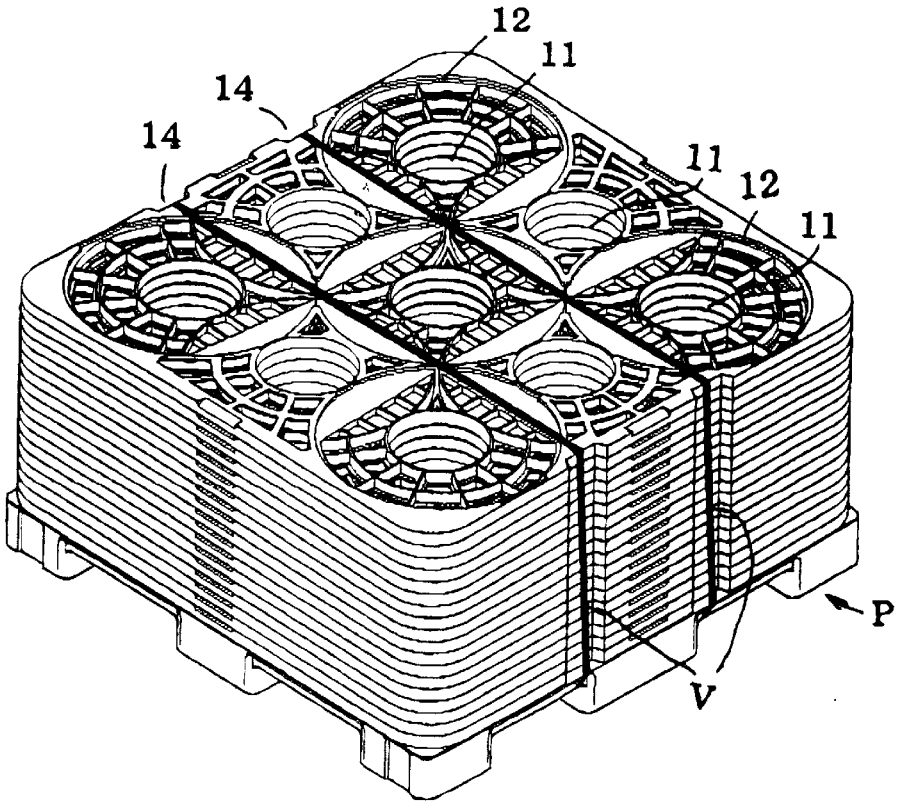
FIG. 11 is a perspective view of a packaged state of supporting and fixing members in a recovery state.

FIG. 1 is a perspective view of a surface of a single piece of the supporting and fixing member (1), FIG. 2 is a perspective view of a rear face of the same, FIG. 3 is a top view, FIG. 4 is a rear view, FIG. 5 is an enlarged sectional view taken along a line A—A of FIG. 3, FIG. 6 is an enlarged sectional view taken along a line B—B of FIG. 3, FIG. 7 is a plane view of a state of piling up tire wheels (H), FIG. 8 is a front view of the state of piling up tire wheels (H), FIG. 9 is an outline sectional view taken along a line C—C of FIG. 7, FIG. 10 is a perspective view of a packaged state and FIG. 11 is a perspective view of a packaged state of the supporting and fixing member (1) in a recovery state.

According to a single piece of the supporting and fixing member (1) constituting a packaging element of the tire wheel (H) (rim radius: 230 mm, hub radius: 90 mm) for a motorcycle according to Embodiment 1 shown in the respective drawings, the supporting and fixing member (1) is made of polypropylene resin. As shown by FIG. 1 through FIG. 6, at the supporting base plate (10) portion having a plate thickness of 18 mm constituting a substantially rectangular contour of a contour size (front width×depth=1180×1140 mm) of a load lifting pallet (P), there are penetrated and aligned hub holes (11). The hub holes (11) having a radius of 95 mm in three rows in longitudinal and transverse directions by a pitch of a value (334 mm) of adding the wheel radius, the hub radius and an allowance interval of 7 mm×2=14 mm.

Further, there are integrally molded respectively with the supporting base plate (10), recess portions (12) each having a depth of 5 mm and providing a guide slope face along an outer diameter of the wheel as movement hampering means on the surface side for hampering horizontal movement of the tire wheel (H). Movement is hampered at respective surroundings of the hub holes (11) at a central portion and on sides of four corners at the surface of the supporting base plate (10), and the recess portions (12) each having a depth of 5 mm and providing a guide slope face along the outer diameter of the wheel as movement hampering means on the rear face side for hampering horizontal movement of the tire wheel (H) at respective surroundings of the hub holes (11) other than the above-described at the rear face of the supporting base plate (10).

Further, at bottom faces of the recess portions (12) on the surface side and the rear face side, there are formed ribs (16) in the form of a penetrated window in a lattice face serving to save resin material and reinforcement. The ribs (16) are formed also at portions of the rear face opposed to the surface other than the recess portions (12) on the surface side and the rear face side.

The respective movement hampering means formed at the surface and the rear face of the supporting base plate (10) are formed such that when the packaging operation is carried out by fitting the projected hubs into the hub holes (11) and sandwiching the tire wheels (H), by using two sheets of single pieces of the supporting and fixing members (1) constituted as described above, in a state in which surfaces thereof are opposed to each other, upper and lower outer peripheral faces of the wheels in a state of falling sideways, are contained in the respective recess portions (12. Thereby, the tire wheels (H) and the supporting and fixing member (1) on the upper side are prevented from being moved horizontally relative to the supporting and fixing member (1) on the lower side, further, in piling up the supporting and fixing members (1) in recovery, the movement hampering means on the surface side and the rear face side of the respectives are brought in mesh with each other, thereby, a thickness of the total is thinned.

Further, at a set of edges of the supporting base plates (10) opposed to each other, there are formed notched portions (14) for positioning and preventing shift of bands (V) for binding and slopes (15) lowering toward the outer side for facilitating to separate single pieces of the supporting and fixing members (1) constituting packaging elements which are piled up in the recovery state, at upper faces of central portions of other set of edges opposed to each other.

Next, an explanation will be given of the packaging method using the supporting and fixing member (1) constituting the packaging element, described above. In the case of piling up 23 pieces of the tire wheels (H) by using the packaging element constituting one set by 6 sheets of the supporting and fixing members (1) in reference to, for example, FIG. 7 through FIG. 9 (however, in FIG. 7, a topmost one of the 6 sheets used is omitted).

First, one sheet of the supporting and fixing member (1) is placed on the pallet (P) with its surface side disposed on the upper side such that 5 tire wheels (H) are loaded, 5 tire wheels (H) are loaded such that the hubs are fitted to the hub holes (11) and the rims are fitted to the recess portions (12) on the surface side constituting the movement hampering means to thereby bring the respectives in a constraint state (state of prohibiting horizontal movement). Thereafter, a second one of the supporting and fixing member (1) is piled up thereon by reverting a surface and a rear face thereof, upper face sides of the tire wheels (H) (with a reference of a case in which the tire wheels (H) are made to fall sideways), are fitted to the recess portions (12) on the surface side of the supporting and fixing member (1) which is directed downwardly. Thereby, 5 tire wheels (H) are supported between 2 sheets of the supporting and fixing members (1) in a sandwiched state.

Next, when the tire wheels (H) are loaded on the second sheet of the supporting and fixing member (1) the rear face side of which is reverted and directed upwardly, 4 tire wheels (H) are fitted and loaded to the hub holes (11) in which the hubs of the tire wheels (H) at a lower stage are not projected from the hub holes (11) of the supporting and fixing member (1), and the recess portions (12) formed at the surroundings. That is, the tire wheels (H) are piled up in the state in which the tire wheels (H) are shifted from the tire wheels (H) supported at the lower stage and are supported such that the hubs of the upper and the lower tire wheels (H) do not interfere with each other.

Successively, a third one of the supporting and fixing member (1) is piled up on upper face sides of 4 pieces of the tire wheels (H) supported at the second stage in a position the same as that of the first one of the supporting and fixing member (1) and 4 tire wheels (H) are supported in the sandwiched state between the second one and the third one of the supporting and fixing members (1) to coincide with the recess portions (12) on the rear face side of the third one of the supporting and fixing member (1).

Further, by the above-described procedure, a fourth one, a fifth one, a sixth one, . . . of the supporting and fixing members (1) are successively piled up, 5 pieces, 4 pieces, 5 pieces . . . of the tire wheels (H) are piled up respectively, the topmost one of the supporting and fixing member (1) (illustration is omitted in the embodiment in FIG. 7) is piled up, the notched portions (14) are aligned in the vertical direction, the bands (V) are made to wrap around the total to thereby bind (refer to FIG. 10, 5 sheets piling is indicated for convenience of illustration in FIG. 10). Thereby, the packaging operation is finished.

Meanwhile, as shown by FIG. 11, recovery of the packaging elements after transportation is carried out by piling up the supporting and fixing members (1) by making the surfaces and the rear faces direct in the same directions and aligning the notched portions and binding the supporting and fixing members (1) by making the bands (V) wrap around the notched portions (14) in the vertical direction. In this case, projected portions formed at rear faces of the recess portions (12) of the supporting base plate (10) on the upper side drop into the recess portions (12) on the surface of the supporting base plate (10) on the lower side and the supporting and fixing members (11) can be piled up in a close contact state without being shifted horizontally from each other.

Thereby, a thickness of piling up the supporting and fixing members (1) in recovery operation becomes a number of piled sheets multiplied by a height of the supporting base plate (10). Piling bulk in recovery operation can be restrained low.

(Embodiment 2)

Figure 12:
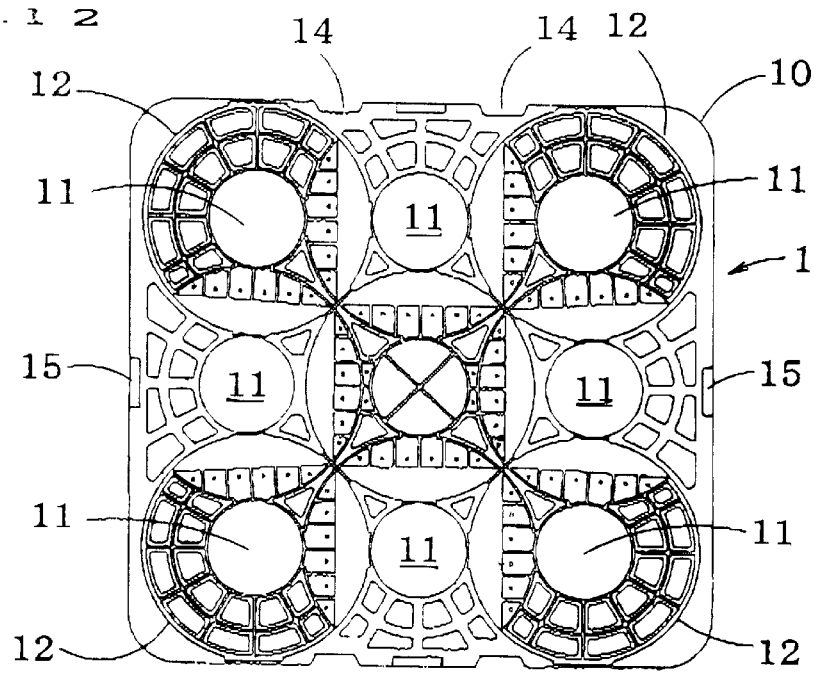
FIG. 12 is a plane view of a supporting and fixing member constituting a packaging element according to Embodiment 2.
Figure 13:
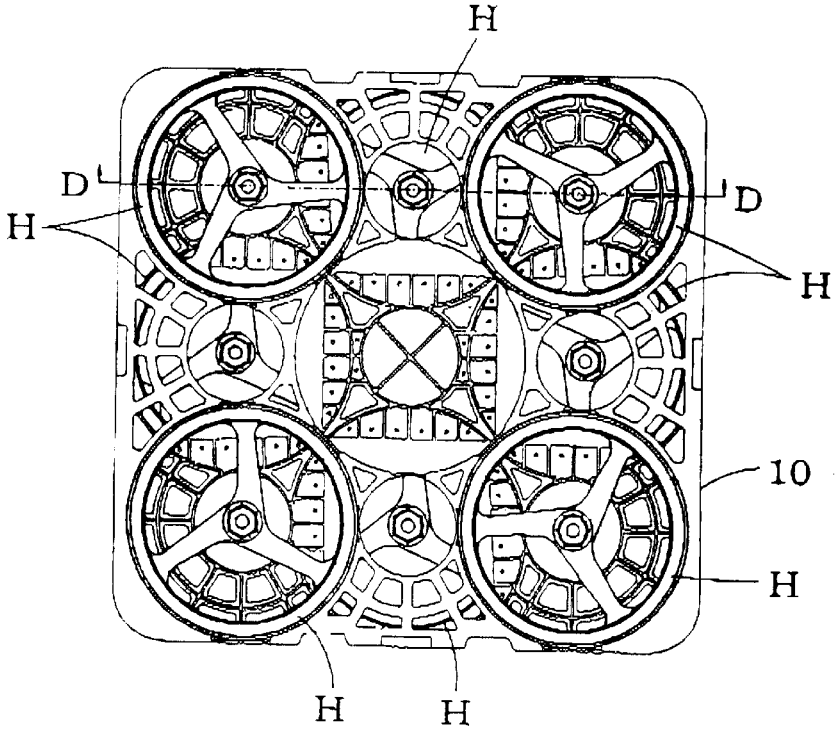
FIG. 13 is a plane view showing a piled-up state in packaging.
Figure 14:
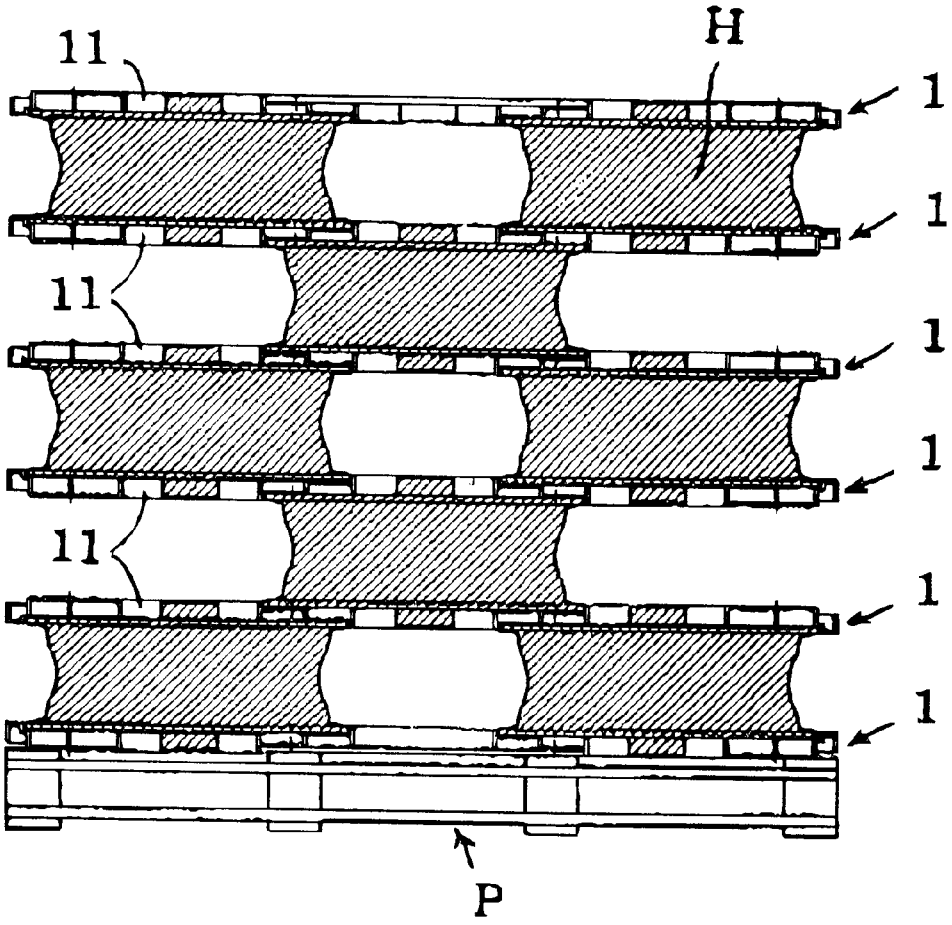
FIG. 14 is an outline sectional view taken along a line D—D of FIG. 13.

FIG. 12 is a plane view of a packaging element according to Embodiment 2, FIG. 13 is a plane view showing a piled-up state in packaging a topmost sheet omitted and FIG. 14 is an outline sectional view taken along a line D—D of FIG. 13 (a topmost sheet omitted in FIG. 13 is included. A point different from Embodiment 1, mentioned above, resides in a number of the hub holes (11) and in the supporting and fixing member (1) and arrangement thereof.

That is, as shown in FIG. 12, according to the supporting base plate (10) having a plate thickness of 18 mm constituted substantially in a rectangular contour of the contour size (front width×depth=1180×1140 mm) of the load lifting pallet (P), there is constructed a constitution in which the hub hole (11) is not present at the central portion and 8 hub holes (11) are penetrated and aligned along sides of the rectangle of the supporting base plate (10) by a pitch of a value (334 mm) of adding the wheel radius, the hub radius and the allowance interval 7 mm×2=14 mm such that a number of supporting the wheels by one sheet of the supporting base plate (10) is four, respectively.

Further, similar to Embodiment 1, there are respectively molded integrally with the supporting base plate (10), the recess portions (12) each having a depth of 5 mm and providing a guide slope along the wheel outer diameter as movement hampering means on the surface side for hampering horizontal movement of the tire wheels (H) at respectives of the surroundings of the hub holes (11) on sides of four corners at the surface of the supporting base plate (10), and the recess portions (12) each having a depth of 5 mm and providing a guide slope along the wheel outer diameter as movement hampering means on the rear face side for hampering horizontal movement of the tire wheel (H) at the rear face of the supporting base plate (10). With regard to other constitution, that is, the notched portions (14) and the like, are similar to those in Embodiment 1 and therefore, a detailed explanation thereof will be omitted.

When the packaging elements according to Embodiment 2 are used, instead of the piled-up state of 5 pieces, 4 pieces . . . of the tire wheels (H) in the case of 5 stages using the packaging elements described in Embodiment 1, mentioned above, there is constituted a piled-up state of 4 pieces, 4 pieces . . . and accordingly, a number of the tire wheels (H) becomes 20 in comparison with 23 of the former case. Therefore, although the number of the tire wheels (H) which can be packaged becomes small, other operation and effect remain the same and therefore, operation and effect is significant in comparison with the conventional packaging elements.

(Embodiment 3)

Figure 15:
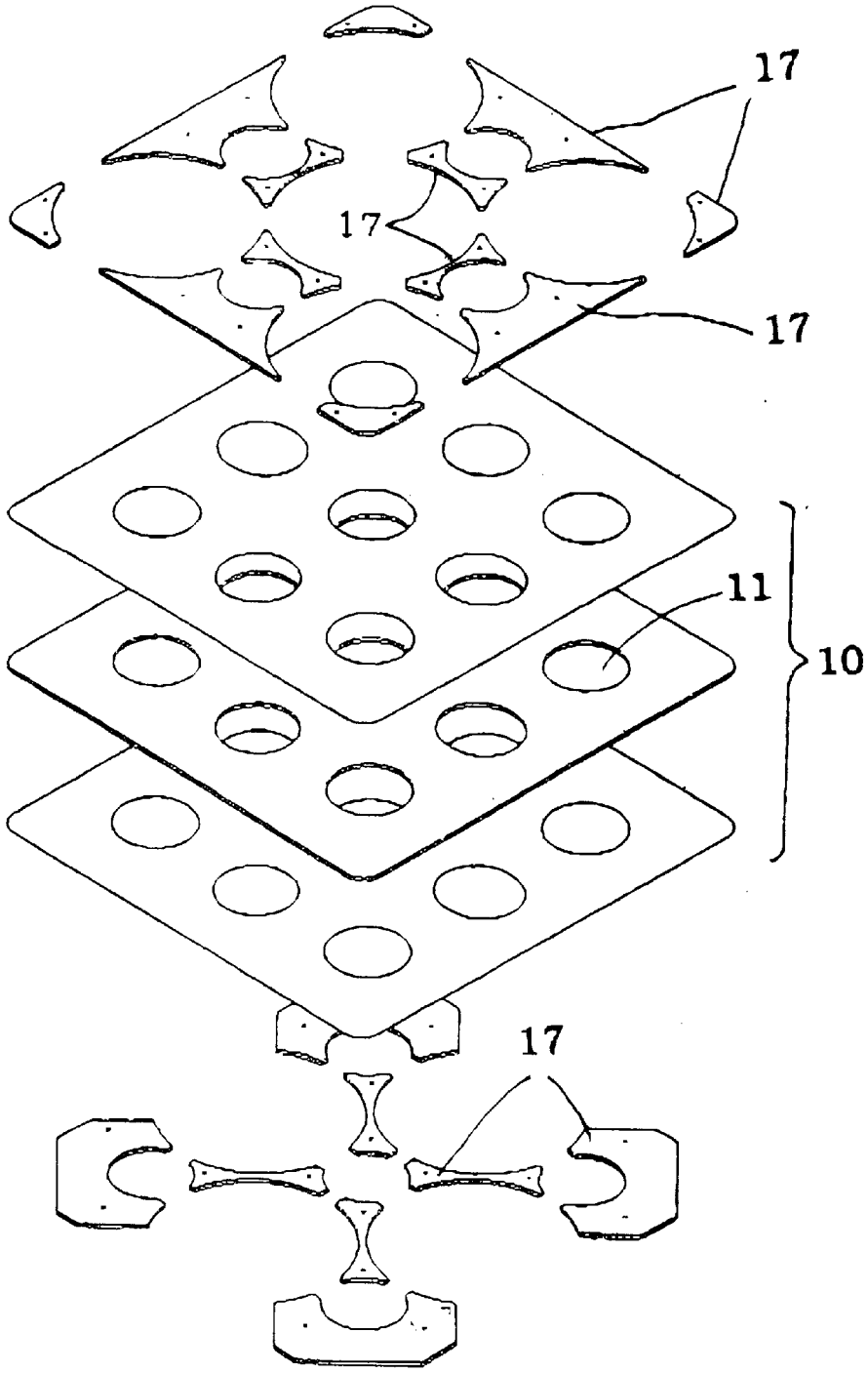
FIG. 15 is a disassembled perspective view of packaging elements according to Embodiment 3.
Figure 16:
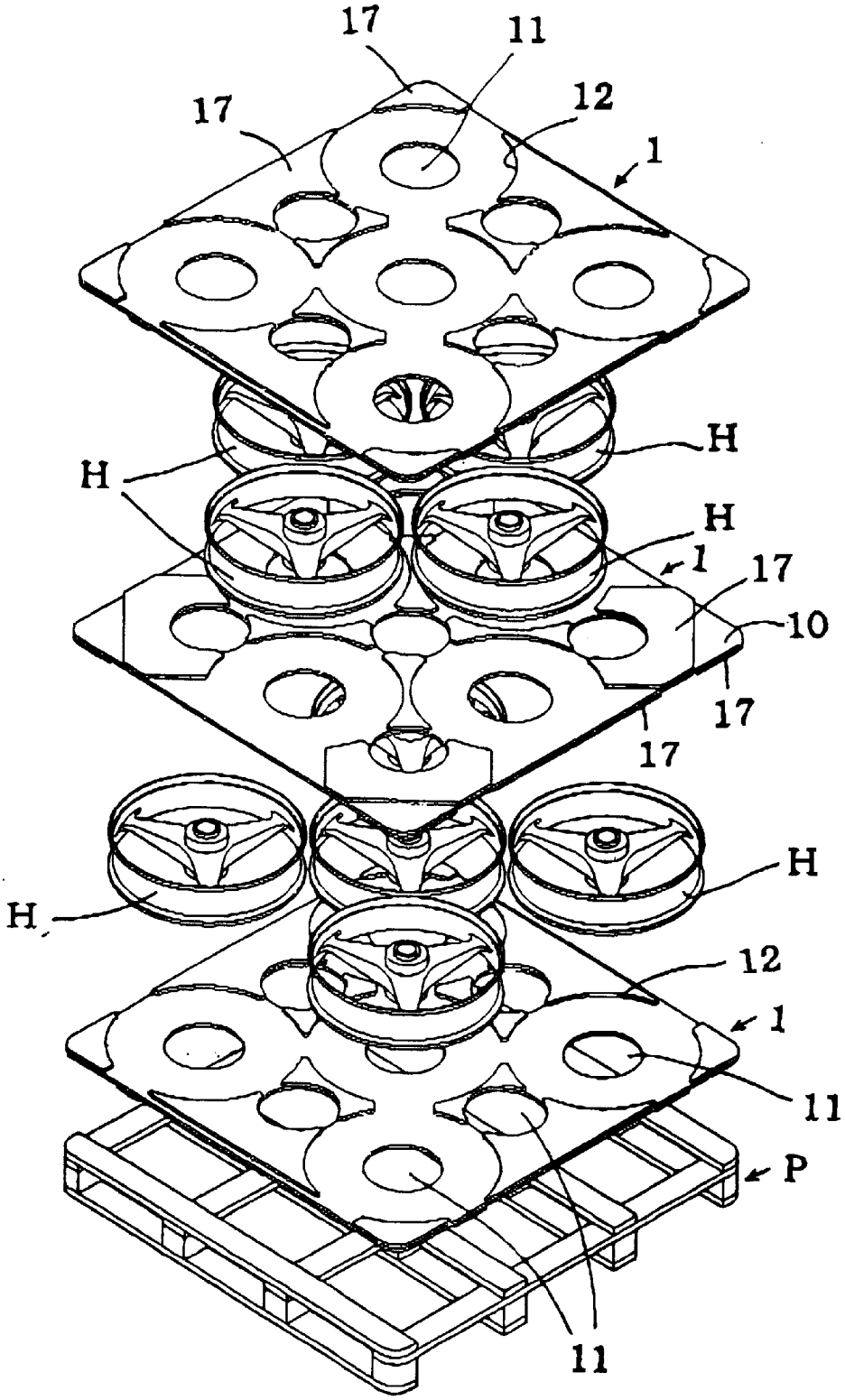
FIG. 16 is a perspective view of a state of loading tire wheels using the packaging elements according to Embodiment 3.

FIG. 15 is a disassembled perspective view of a packaging element according to Embodiment 3, a point of difference from Embodiments 1 and 2, mentioned above, resides in that the supporting and fixing member (1) is constituted by a laminated structure having a constitution characterized in that the supporting base plate (10) is constituted by laminated sheet or decorative laminated sheet the surface of which is subjected to waterproof treatment (covered by cured sheet or waterproof sheet). Pieces (17) each for forming a stepped wall in contact with the rim along the outer diameter of the rim, are fixed by screws to both faces of the surface and the rear face as horizontal movement hampering means of the tire wheels (H), a state of loading the tire wheels (H) is shown by FIG. 16. An explanation of other detailed constitution will be omitted by only describing that there are a case of providing 9 of the hub holes (11) described in Embodiment 1 and a case of providing 8 of the hub holes (11) described in Embodiment 2.

According to the constitution of fixing the pieces (17) by screws in this way, when a portion of achieving a function of hampering the horizontal movement is damaged, by interchanging the damaged portion, the function as the packaging element can be recovered and substantial durability can be achieved. Further, although means for attaching the pieces (17) may be adhering or the like, so far as parts can be interchanged in destruction, and so far as the attaching means is solid coupling means which does not cause unprepared detachment, the attaching means is not limited to fixing by screws but there can be adopted fixedly attaching means of fixing by calking, fixing by anchor, fixing by fitting, fixing by welding and so on.

(Embodiment 4)

Figure 17:
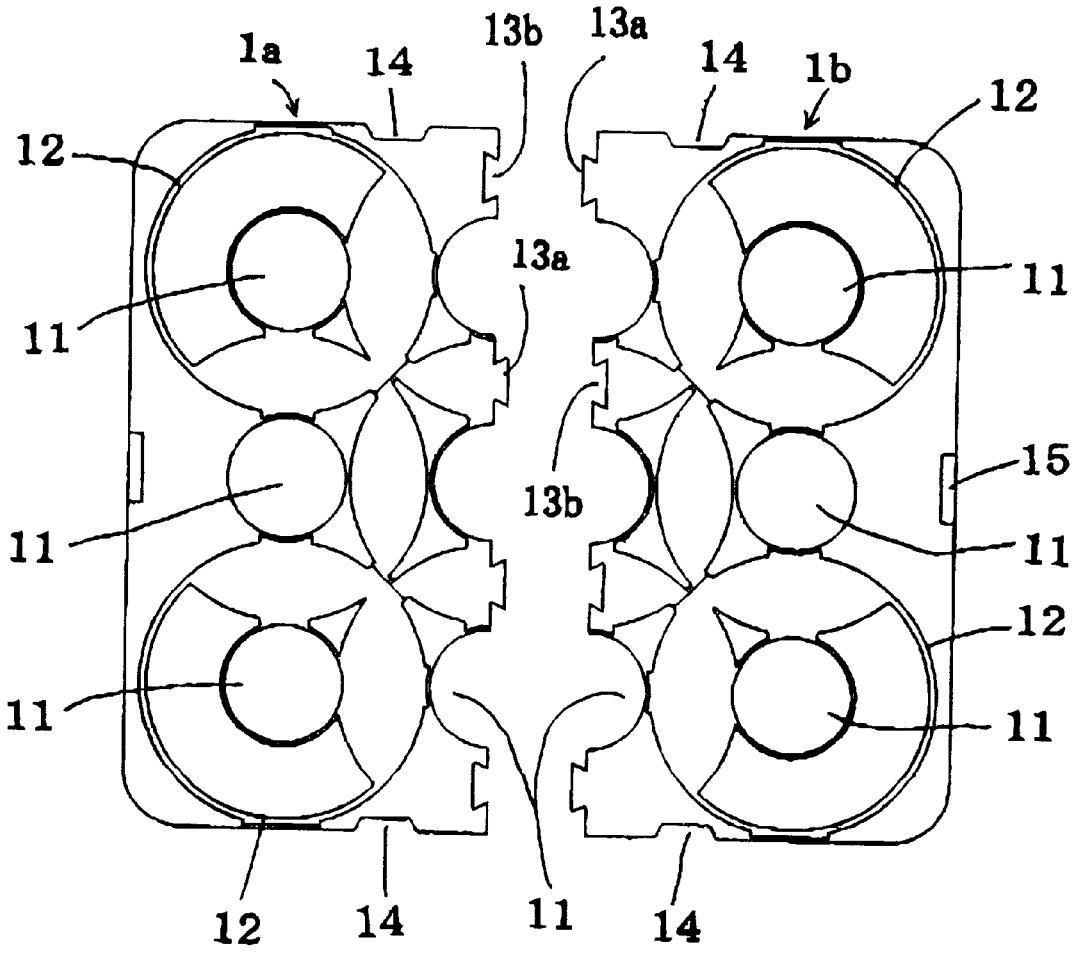
FIG. 17 is a disassembled plane view of a packaging element according to Embodiment 4.

FIG. 17 is a disassembled plane view of a packaging element according to Embodiment 4, which is featured in a constitution in which the supporting and fixing member (1) described in Embodiment 1 or 2 is divided into a shape constituting symmetry in left and right direction with a center line in the vertical direction as a reference line to thereby constitute divided supporting and fixing members **(1*a*) and (1*b*) and edges of the division are connected by integrally forming connecting means of dovetail projections (13*a*) and dovetail groove recesses (13*b*) fitted thereto to thereby pile up the supporting and fixing member (1) as a one sheet article and surfaces. Rear faces of the divided supporting and fixing members (1*a*) and (1*b*) are respectively molded with, by integral molding, the hub holes (11) and the recess portions (12) each having a depth of 5 mm and providing a guide slope along the wheel diameter at a surrounding of the hub hole (11) similar to those in Embodiment 1 or 2 when the divided supporting and fixing members (1*a*) and (1*b*)** are connected to constitute the one sheet article. In view of fabrication of dies, capacity of a molding machine used, a storage state and the like in molding by resin, the constitution achieves an advantage in ensuring economic performance, handling, storage space and the like in comparison with the cases of Embodiments 1 and 2, mentioned above.

Further, other constitution, that is, the notched portion (14) or the like is similar to that in Embodiment 1 and therefore, a detailed explanation thereof will be omitted.

Further, as means for connecting a pair of the divided supporting and fixing members **(1*a*) and (1*b*)**, although the pair cannot be divided, when the pair can be folded by other foldable connecting means of a hinge made of resin or the like, in packaging operation, the pair can be developed and used as the one sheet article and in recovering operation, the pairs can be used by piling up the pairs in a two-folded state to thereby lower the bulk and binding the pairs by the bands (V).

Although packaging in the case of the divided constitution is similar to that in the other embodiments, in recovery or storage, although the piled-up height is increased, the occupied mounting area can be halved. Therefore depending on means of recovery or storage, not only flat plate piling or folded piling can be selected but also in fabrication thereof, as described above, a die smaller than that of the case of the one sheet article can be used, particularly in fabricating a packaging element in the mode of Embodiment 2 constituting the left and the right and up and down symmetry two sheets of the same article can be combined as a pair. Accordingly, there is achieved an advantage in which even when one piece is damaged by which the one piece cannot be used, other piece which is not damaged can effectively be utilized by being combined with one piece matching therewith.

Although according to the packaging element (which is the supporting and fixing member (1)) of the tire wheel according to the present invention constituted as described above, the hubs of the tire wheels (H) are projected from the opened hub holes (11) of the second sheet of the supporting and fixing member (1), the hub holes (11) contiguous to the hub holes (11) are not closed but are brought into the opened state and therefore, the tire wheels (H) can be mounted on the second sheet of the supporting and fixing member (1) such that the hubs are inserted into respectives of the hub holes (11).

Therefore, the hubs of the respective tire wheels (H), piled up on the upper side and the lower side can be piled up in the state having a low bulk in which the hubs extend into loading space without interfering with each other. And therefore, by using a plurality of the supporting and fixing members (1), even when the tire wheels (H) are loaded in several stages of five pieces, four pieces, five pieces, four pieces thereof or in four pieces, the tire wheels (H) can be piled up compactly such that the hubs do not interfere with each other.

Further, the tire wheels (H) at the respective stages can be piled up without moving horizontally by the respective movement hampering means on the surface side and the rear face side. Accordingly, the tire wheels (H) can be packaged and piled up safely and stably without causing damage or the like of the tire wheels (H) and the efficiency of loading the tire wheels (H) to a container can be promoted.

Further, in recovering the above-described packaging elements, with regard to piling of the supporting and fixing members (1), the supporting and fixing members (1) are piled up with low bulk in the stable state in which the respective movement hampering means on the surface side and the rear face side are in mesh with each other to thereby prevent horizontal shift and these are bound by the bands (V). Thereby, even when a number of the supporting and fixing members (1) are piled up and bound by the bands (V) in one operation, the packaging elements can efficiently be recovered without causing collapse and can be reutilized.

Further, by providing the supporting and fixing member (1) in which a pair of the divided supporting and fixing members (1*a*) and (1*b*) the shape of which is divided in left and right symmetry (including complete symmetry), is made to constitute the one sheet article by the connecting means, the supporting and fixing member (1) can be fabricated inexpensively by a material or a molding die having a half of a required area. Further, even when the height of the supporting and fixing members (1) in storage or recovery is increased, the supporting and fixing members (1) can be piled up by a half of the occupied area and accordingly, the economic performance in storing or recovering the supporting and fixing members (1) is improved.

Further, by constituting the supporting and fixing member (1) and the divided supporting and fixing member (1) by an integral molded member made of synthetic resin, the supporting and fixing member (1) or the divided supporting and fixing member (1) can be fabricated easily in forming the stepped wall in contact with the rim by forming the recess portion (12), fixing the piece and projecting a plurality of stopper pins.

Further, there can be constituted the packaging element of the tire wheel (H) capable of ensuring the durability almost regardless of storage or transportation environment and optimum in repeated use.

Further, although as synthetic resin, thermoplastic synthetic resin or a hard one thereof is optimum, the synthetic resin is not particularly limited so far as the synthetic resin is provided with strength and hardness firmly supporting horizontally the weight of the tire wheels (H) or may be the thermoplastic synthetic resin.

Further, when the supporting and fixing member (1) is provided by constituting the supporting base plate (10) by laminated sheet or decorative laminated sheet subjected to waterproof treatment, forming the stepped wall in contact with the rim at either of the outer side and the inner side of the rim of the wheel at the surface and the rear face as horizontal movement hampering means of the tire wheel (H), fixing the pieces (17) by means of either of means for projecting a plurality of stopper pins and means for adhering, fitting, welding or screwing thereof to the supporting base plate (11). Although the durability of the supporting base plate (10) is slightly inferior (particularly in laminated sheet) with regard to destruction of the horizontal movement hampering means, the function can be recovered by partial repair.

Further, by constructing the constitution in which as the horizontal movement hampering means of the wheels at the surfaces and the rear faces of the supporting base plates (10), when the supporting and fixing members (1) are piled up by making the surfaces and the rear faces direct in the same direction, respective recesses and projections of the piled-up faces are brought in mesh with each other. The thickness of piling becomes a number of sheets of piling multiplied by a thickness of the supporting base plate (10). In piling up the respective supporting and fixing members (1), the respective movement hampering means on the surface side and the rear face side are brought in mesh with each other and the supporting and fixing members (1) can be bound by the piling bands (V) in a state in which the thickness of the total is thinned. Accordingly, even when a number of the supporting and fixing members (1) are piled up and bound by the bands (V) in one operation, the supporting and fixing members (1) can be recovered and reused extremely efficiently without causing collapse.

What is claimed is:

1. A packaging assembly, comprising:

at least three sheets of supporting and fixing members, each sheet including plural hub holes;

a first set of plural tire wheels located between two of said sheets, each tire wheel having a hub extending therefrom and engaging a hub hole; one of said two sheets supporting said first set of tire wheels and the other of said two sheets being supported by said first set of tire wheels; and a second set of plural tire wheels located between one of said two sheets and a third of said sheets, each wheel of the second set including a hub engaged with a hub hole of the third sheet or of one of the two sheets, wherein hub engagement of each wheel with a hub hole for one of the sets of tire wheels is laterally offset from the perimeter of all of the wheels of the other one of the sets; and means for preventing lateral movement of the tire wheels in each set.

2. The packaging assembly according to claim 1, wherein the number of the tire wheels supported by adjacent sheets is alternately five and four.

3. The packaging assembly according to claim 1, wherein the supporting and fixing member comprises a pair of divided generally symmetrical supporting and fixing member halves connected by connecting means.

4. The packaging assembly according to claim 1 or 3, wherein the supporting and fixing member is an integrally molded member made of a synthetic resin.

5. The packaging assembly according to claim 1, wherein the supporting base plate comprises a laminated sheet or a decorative laminated sheet subjected to waterproof treatment and the means for preventing lateral movement of the tire wheel comprise raised or recessed areas on said sheets.

6. The packaging assembly according to claim 1, wherein said means for preventing lateral movement of the tire wheel comprises either a recess portion in said sheet for fitting a peripheral edge of an outer diameter of a rim of the tire wheel or a projected portion adapted to support an inner diameter portion of the rim, wherein said recess portions or said projected portions are attached by any of adhering, fitting, welding or screwing to the supporting base plate.

7. The packaging assembly according to claim 1, wherein the number of wheels supported by each sheet is four.

* * * * *